US012391444B2

(12) United States Patent
Zhang et al.

(10) Patent No.: US 12,391,444 B2
(45) Date of Patent: Aug. 19, 2025

(54) STORAGE AND TRANSPORTATION DEVICE

(71) Applicant: CONTEMPORARY AMPEREX TECHNOLOGY (HONG KONG) LIMITED, Hong Kong (CN)

(72) Inventors: Lei Zhang, Fujian (CN); Xiong He, Fujian (CN); Jun Ming, Fujian (CN); Tao Du, Fujian (CN)

(73) Assignee: CONTEMPORARY AMPEREX TECHNOLOGY (HONG KONG) LIMITED, Hong Kong (CN)

( * ) Notice: Subject to any disclaimer, the term of this patent is extended or adjusted under 35 U.S.C. 154(b) by 57 days.

(21) Appl. No.: 18/528,302

(22) Filed: Dec. 4, 2023

(65) Prior Publication Data

US 2024/0101323 A1 Mar. 28, 2024

Related U.S. Application Data

(63) Continuation of application No. PCT/CN2022/129778, filed on Nov. 4, 2022.

(30) Foreign Application Priority Data

Nov. 26, 2021 (CN) ..... 202122943005.6

(51) Int. Cl.
*B65D 53/00* (2006.01)
*B65D 43/02* (2006.01)

(52) U.S. Cl.
CPC ..... *B65D 53/00* (2013.01); *B65D 43/0206* (2013.01); *B65D 2543/00453* (2013.01); *B65D 2543/00962* (2013.01)

(58) Field of Classification Search
CPC ..... B65D 53/00; B65D 43/0206; B65D 2543/00453; B65D 2543/00962;
(Continued)

(56) References Cited

U.S. PATENT DOCUMENTS 5,785,201 A * 7/1998 Bordner ..... B65D 43/0218 206/508
6,364,152 B1 * 4/2002 Poslinski ..... A47J 47/10 220/240
(Continued)

FOREIGN PATENT DOCUMENTS

CN 202971892 U 6/2013
CN 207052642 U 2/2018
(Continued)

OTHER PUBLICATIONS

Extended European Search Report dated Sep. 4, 2024 for application EP 22897580.1.
(Continued)

*Primary Examiner* — Kareen K Thomas
(74) *Attorney, Agent, or Firm* — Ladas & Parry LLP

(57) ABSTRACT

A storage and transportation device, which relates to the technical field of storage and transportation apparatuses are disclosed. The storage and transportation device comprises a cover, a supporting plate and a sealant. The supporting plate covers an opening of the cover to form a space for accommodating an item to be transported. The storage and transportation device further comprises a first sealant groove and a second sealant groove arranged at a sealed junction between the cover and the supporting plate, the sealant is contained in each of the first sealant groove and the second sealant groove, and the two parts of the sealant are connected.

10 Claims, 8 Drawing Sheets

(58) Field of Classification Search
CPC ..... B65D 81/24; B65D 53/02; B65D 2519/00024; B65D 2519/00034; B65D 2519/00059; B65D 2519/00164; B65D 2519/00174; B65D 2519/00199; B65D 2519/00208; B65D 2519/00273; B65D 2519/00288; B65D 2519/00323; B65D 2519/00333; B65D 2519/00497; B65D 2519/00621; B65D 2519/00641; B65D 2519/00716; B65D 2585/88; B65D 19/08; B65D 19/18; B65D 19/06
See application file for complete search history.

(56) References Cited

U.S. PATENT DOCUMENTS

| | | | | |
|---|---|---|---|---|
| 7,114,617 | B2 * | 10/2006 | Yewdall | B65D 43/0206 206/592 |
| 7,648,041 | B2 * | 1/2010 | Ueda | H01L 21/67126 220/323 |
| 8,579,150 | B2 * | 11/2013 | Janny | B65D 51/1616 220/795 |
| 8,792,249 | B2 * | 7/2014 | Sasamori | H04M 1/0262 361/679.01 |
| 8,899,443 | B2 * | 12/2014 | Soibel | B65D 43/0233 220/795 |
| 8,910,815 | B2 * | 12/2014 | Mellander | B60K 15/03 220/795 |
| 10,155,611 | B2 * | 12/2018 | Grant | B65D 77/202 |
| 10,322,262 | B2 * | 6/2019 | Bracken | A61M 25/02 |
| 10,759,588 | B1 | 9/2020 | Lobisser et al. | |
| 10,906,734 | B2 * | 2/2021 | Richter | B65D 88/76 |
| 11,794,959 | B2 * | 10/2023 | Freedman | B65D 43/162 |
| 2003/0106831 | A1 | 6/2003 | Eggum | |
| 2007/0170190 | A1 * | 7/2007 | Milesi | A45D 40/22 220/806 |
| 2008/0110549 | A1 | 5/2008 | Anderson | |
| 2008/0308555 | A1 * | 12/2008 | Stolzman | B65D 43/0231 220/288 |
| 2009/0152271 | A1 * | 6/2009 | Kuzelka | B65D 45/345 220/319 |
| 2010/0200599 | A1 * | 8/2010 | Molthen | B65D 19/06 220/592.27 |
| 2014/0127544 | A1 | 5/2014 | Min | |
| 2019/0161238 | A1 | 5/2019 | Uchimura et al. | |

FOREIGN PATENT DOCUMENTS

| | | | |
|---|---|---|---|
| CN | 207809437 | U | 9/2018 |
| CN | 111245982 | A | 6/2020 |
| CN | 212783605 | U | 3/2021 |
| CN | 213124609 | U | 5/2021 |
| CN | 214505658 | U | 10/2021 |
| CN | 216333673 | U | 4/2022 |
| JP | 2007165132 | A | 6/2007 |
| JP | 2015201593 | A | 11/2015 |
| JP | 2019185945 | A | 10/2019 |

OTHER PUBLICATIONS

International Search Report dated Jan. 18, 2023 for Application No. PCT/CN2022/129778.

* cited by examiner

STORAGE AND TRANSPORTATION DEVICE

The present application is a continuation of International application PCT/CN2022/129778 filed on Nov. 4, 2022 that claims priority to Chinese Patent Application No. 202122943005.6, filed on Nov. 26, 2021. The contents of these applications are incorporated herein by reference in its entirety.

TECHNICAL FIELD

Embodiments of the present application relates to the technical field of storage and transportation apparatuses, and in particular to a storage and transportation device.

BACKGROUND ART

Secondary batteries have lots of advantages such as high energy density, high output power, long charging and discharging service life, no pollution, wide operating temperature range, small self-discharge, etc. As a novel high-energy chemical power supply, the secondary batteries have been widely used in the fields of mobile phones, computers, electric vehicles and the like in recent years, and have advantages such as long endurance time, long service life, low self-discharge rate, environmental friendliness, etc.

Battery electrode plates are important constituent components of the secondary batteries, which involve a very important process during production of the secondary batteries, and are the core parts of the secondary batteries. During the production of the secondary batteries, a plurality of turnaround operation steps, such as storage, transportation, drying, etc., are required for the battery electrode plates. In these turnaround operation steps, since the battery electrode plates are directly in contact with ambient air, the humidity of the ambient air may affect the moisture content in the battery electrode plates, thus affecting the safety and performance of the finally prepared secondary batteries.

SUMMARY OF THE INVENTION

Technical Problem

In view of the safety and performance issues of secondary batteries, embodiments of the present application provide a storage and transportation device, which can ensure constant humidity in the storage and transportation device and thus the moisture content of each battery electrode plate, and thus ensure the safety and performance of prepared secondary batteries.

Solutions to Problem

Technical Solutions

According to an aspect, the embodiments of the present application provide a storage and transportation device, comprising a cover, a supporting plate and a sealant. The supporting plate covers an opening of the cover to form a space for accommodating an item to be transported. The storage and transportation device further comprises a first sealant groove and a second sealant groove, the first sealant groove being arranged at a sealed junction between the cover and the supporting plate; the sealant comprises a first part and a second part, the first part and the second part being respectively located in the first sealant groove and the second sealant groove, and the first part being connected to the second part. The sealant is configured to seal the cover and the supporting plate.

In some embodiments, the first sealant groove is in communication with the second sealant groove.

With the foregoing solution, the sealant in the first sealant groove may flow to the sealant in the second sealant groove, and vice versa. When the cover covers the supporting plate, the sealant overflowing from the first sealant groove can flow to the second sealant groove, and the sealant overflowing from the second sealant groove can also flow to the first sealant groove, facilitating that the sealant is remained in the gap between the cover and the supporting plate and thus is not compressed out of the gap, thereby facilitate improvement of the sealing performance of the storage and transportation device.

In some embodiments, both the first sealant groove and the second sealant groove are arranged on an open end of the cover in a circumferential direction of the cover.

This solution provides an arrangement of the first sealant groove and the second sealant groove. The two sealant grooves each contain the sealant, the sealant in the two sealant grooves are connected, and the sealant connected is filled in the gap at the sealed junction between cover and supporting plate to seal the gap, thereby lengthening a water permeation path between the cover and the supporting plate, effectively cutting off the passage for moisture, and reducing the possibility of moisture entry to ensure that the humidity in the storage and transportation device remains constant.

In some embodiments, both the first sealant groove and the second sealant groove are arranged on the supporting plate in the circumferential direction of the cover.

This solution provides another arrangement of the first sealant groove and the second sealant groove. The supporting plate has a large plate surface, and the first sealant groove and the second sealant groove are provided on the supporting plate, thereby reducing the risk that it is difficult to provide the first sealant groove and the second sealant groove both on the open end of the cover due to a limited size of the open end of the cover at the sealed junction.

In some embodiments, one of the first sealant groove and the second sealant groove is arranged on the open end of the cover in the circumferential direction of the cover, and the other one of the first sealant groove and the second sealant groove is arranged on the supporting plate in the circumferential direction of the cover.

This solution provides yet another arrangement of the first sealant groove and the second sealant groove, in which the first sealant groove and the second sealant groove are arranged on the open end of the cover and the supporting plate respectively, thereby reducing the risk that the first sealant groove and the second sealant groove cannot be both arranged on the open end of the cover or on the supporting plate due to the limited size of the open end of the cover or of the supporting plate at the sealed junction, and also avoiding an substandard strength of the cover or the supporting plate due to the arrangement of both the first sealant groove and the second sealant groove on the cover or on the supporting plate.

In some embodiments, a plurality of second sealant grooves are provided, and the plurality of second sealant grooves are staggered with each other.

The plurality of second sealant grooves are staggered with each other. If the plurality of second sealant grooves are all fully filled with the sealant, the sealant in the plurality of second sealant grooves will remain at different positions in the gap between the cover and the supporting plate, so that the sealing area at the sealed junction can be increased, which is beneficial to improving the sealing performance of the storage and transportation device.

In some embodiments, when a plurality of second sealant grooves are provided, the second sealant grooves may be arranged on each of the open end of the cover and the supporting plate.

The second sealant grooves are separately arranged on the open end of the cover and the supporting plate, thereby reducing the risk that the plurality of second sealant grooves cannot all be arranged on the open end of the cover or on the supporting plate due to the limited size of the open end of the cover or of the supporting plate at the sealed junction, and also avoiding an substandard strength of the cover or the supporting plate due to the arrangement of all of the plurality of second sealant grooves on the cover or the supporting plate.

In some embodiments, an insertion element is further arranged at the sealed junction. The insertion element has a first end and a second end opposite to each other, wherein the first end is connected to the cover or the supporting plate, and the second end extends into the first sealant groove.

With the above solution, the second end of the insertion element extends into the first sealant groove to compress the sealant in the first sealant groove such that the sealant in the first sealant groove readily overflows to the sealed junction to increase the amount of the sealant accumulated at the sealed junction, thereby improving the sealing effect of the storage and transportation device. In addition, the second end of the insertion element extends into the first sealant groove, so that ambient moisture may enter the storage and transportation device only by bypassing the second end of the insertion element, lengthening the water permeation path at the sealed junction, effectively cutting off the passage for moisture, and reducing the possibility of moisture entry to ensure that the humidity in the storage and transportation device remains constant.

In some embodiments, the insertion element is an annular structure extending in the circumferential direction of the cover, and the insertion element is connected to the cover or the supporting plate.

With the above solution, the insertion element can compress the sealant in the first sealant groove or the second sealant groove at various positions in the circumferential direction of the cover to cause the sealant in the first sealant groove or the second sealant groove to readily overflow to the sealed junction, thereby improving the sealing effect of the sealant. Furthermore, the insertion element can extend into the first sealant groove or the second sealant groove along the entire circumference of the cover in the circumferential direction, and the ambient moisture along the entire circumference of the cover in the circumferential direction may enter the storage and transportation device only by bypassing the second end of the insertion element, so that the insertion element can lengthen the water permeation path at various positions in the circumferential direction of the cover, further effectively cut off the passage for moisture, and reduce the possibility of moisture entry to ensure that the humidity in the storage and transportation device remains constant.

In some embodiments, when the second end of the insertion element extends into the first sealant groove, there is a spacing between the second end of the insertion element and the bottom of the first sealant groove.

With the above solution, the water permeation path is not interrupted at this spacing, and thus the effect of the improvement of the sealing performance by the insertion element is not impaired.

In some embodiments, the storage and transportation device further comprises a locking mechanism configured to lock the cover to the supporting plate.

The cover is locked to the supporting plate by the locking mechanism to enhance the stability of a connection between the cover and the supporting plate, preventing the failure in the connection between the cover and the supporting plate during transportation which may otherwise result in a gap and thus inefficient sealing. Furthermore, the sealant in the first sealant groove and the second sealant groove and at the sealed junction are compressed during locking, and it is easy to achieve uniform distribution of the sealant over a larger area at the sealed junction under the action of compression, which is beneficial to improving the sealing effect of the sealant.

In some embodiments, a connector is provided at the open end of the cover in the circumferential direction, and the connector protrudes from an outer wall of the cover, is configured to connect the cover to the supporting plate, and is in contact with the sealant.

With the above solution, the contact surface between the cover and the supporting plate can be increased, the locking of the cover to the supporting plate is facilitated, and the failure in the connection between the cover and the supporting plate during transportation which may otherwise result in inefficient sealing is prevented. The connector is in contact with the sealant, thereby increasing the sealing area between the cover and the supporting plate, effectively cutting off the passage for moisture, and reducing the possibility of moisture entry to ensure that the humidity in the storage and transportation device remains constant.

The aforementioned description is merely an overview of the technical solutions of the embodiments of the present application. In order to more clearly understand the technical means of the embodiments of the present application to implement the technical means according to the content of the description, and in order to make the above and other objectives, features and advantages of the embodiments of the present application more obvious and understandable, specific implementations of the present application are illustratively described below.

BENEFICIAL EFFECTS OF THE INVENTION

Beneficial Effects

In the present application, a gap between the cover and the supporting plate is sealed by two connected parts of sealant to effectively cut off the passage for moisture and reduce the possibility of moisture in the ambient environment entering the storage and transportation device, thereby achieving a good sealing effect to ensure that the humidity in the storage and transportation device remains constant. In the present application, the control of the humidity in the storage and transportation device does not rely on a desiccant, so the storage and transportation device is suitable for prolonged dry storage and transportation.

BRIEF DESCRIPTION OF THE DRAWINGS

Description of the Drawings

In order to more clearly illustrate the technical solutions in the embodiments of the present application, the drawings to be used in the description of the embodiments will be described briefly below. Obviously, the drawings in the following description are merely some embodiments of the present application. For those of ordinary skill in the art, other drawings can also be obtained according to these drawings without creative efforts.

Figure 1:
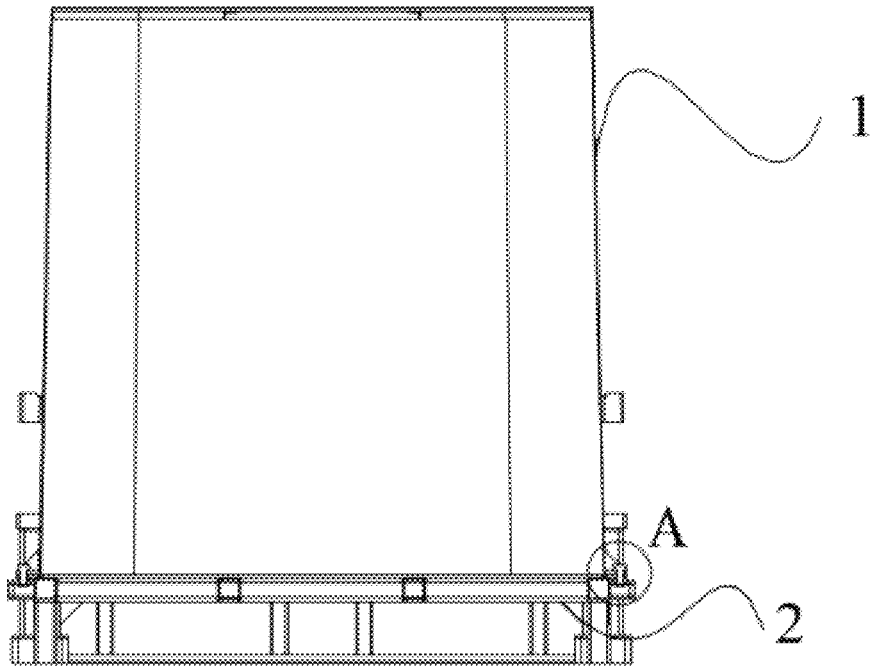

FIG. 1 is a schematic structural diagram of a storage and transportation device according to an embodiment of the present application, with a cover covering a supporting plate.

Figure 2:
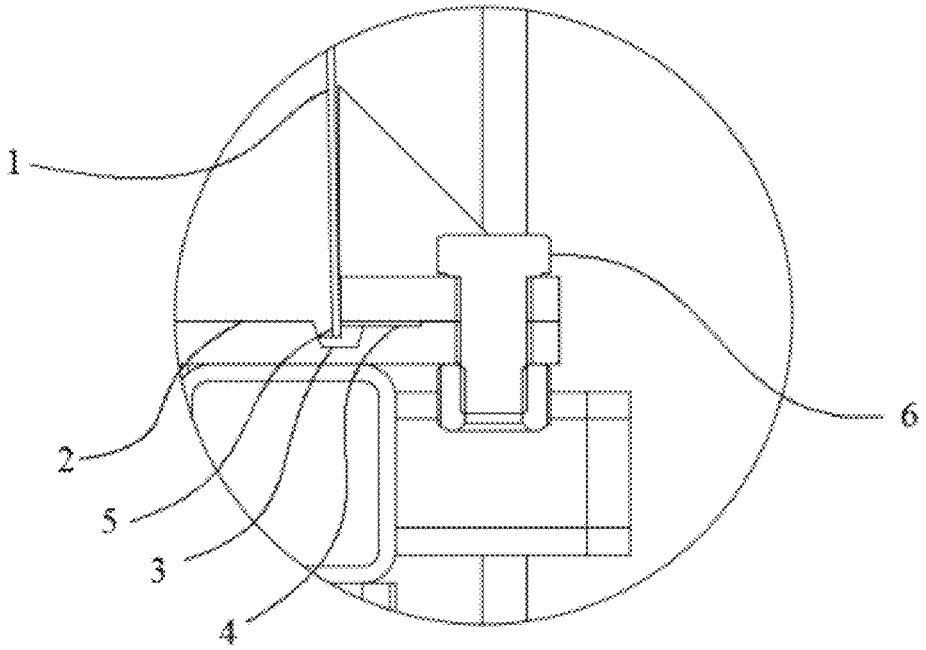

FIG. 2 is an enlarged view of part A of FIG. 1.

Figure 3:
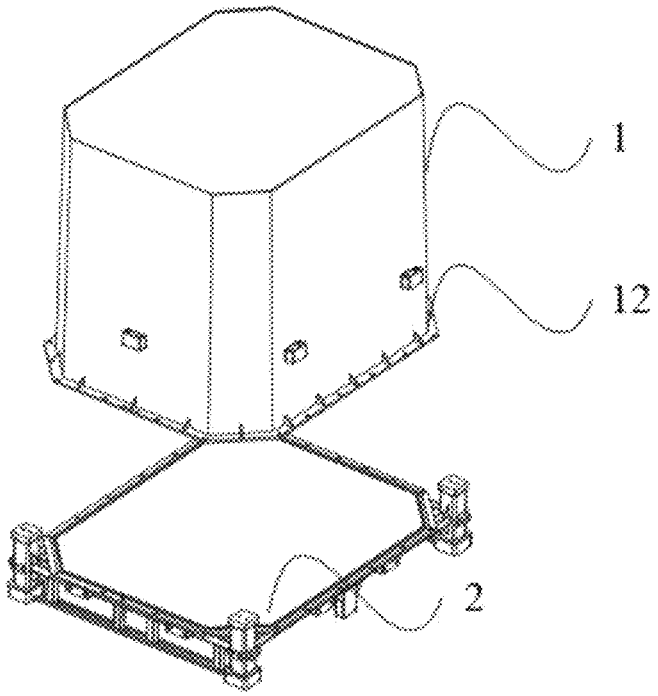

FIG. 3 is a schematic structural diagram of another storage and transportation device according to an embodiment of the present application, with a cover not covering a supporting plate.

Figure 4:
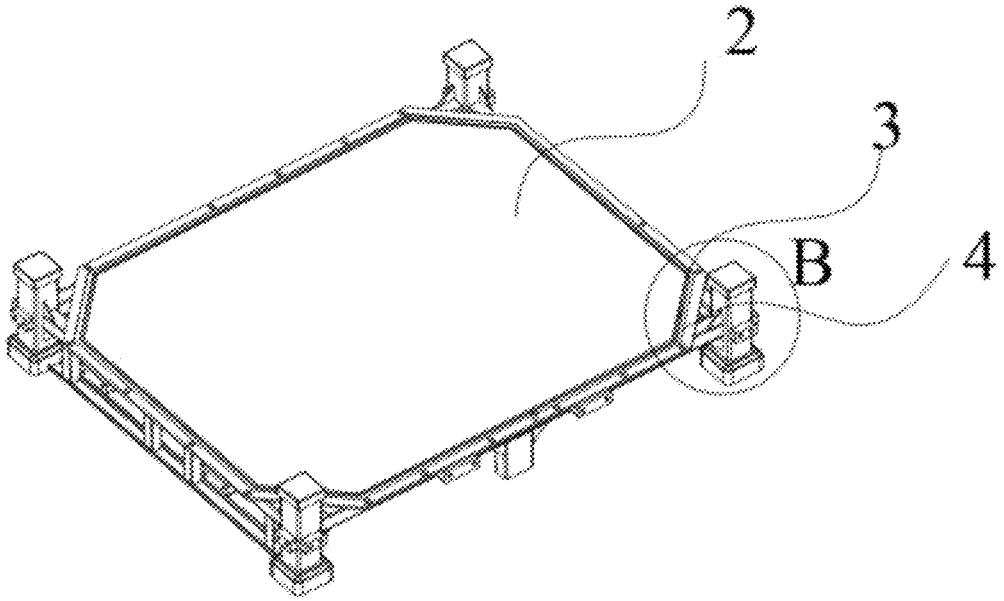

FIG. 4 is a schematic structural diagram of a supporting plate according to an embodiment of the present application.

Figure 5:
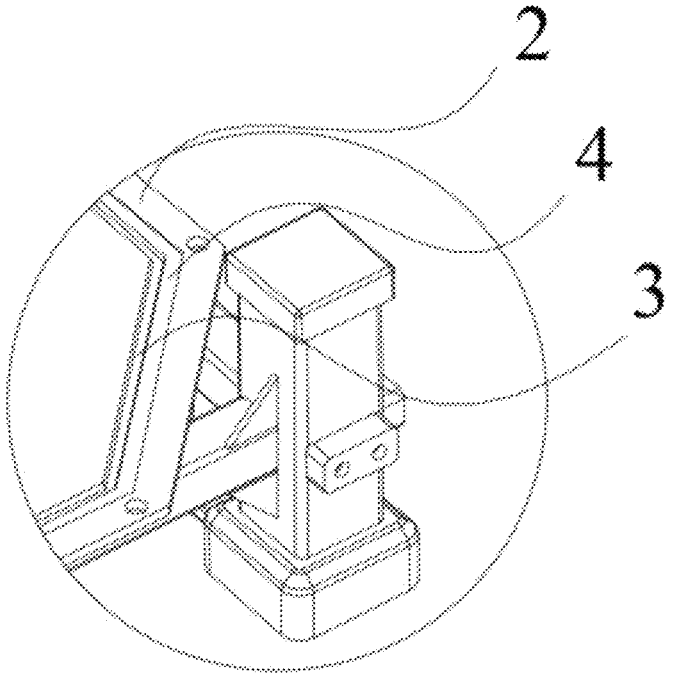

FIG. 5 is an enlarged view of part B of FIG. 4.

Figure 6:
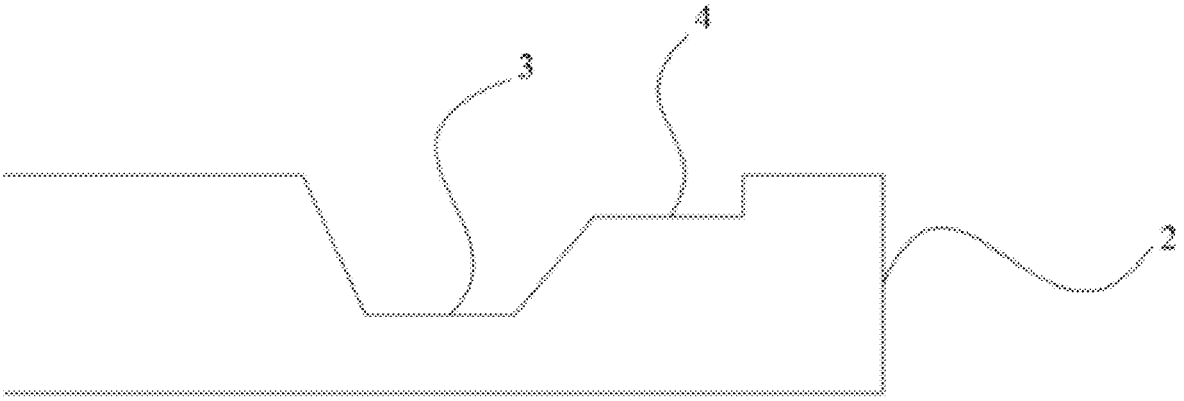

FIG. 6 is a schematic structural diagram of a first sealant groove and a second sealant groove according to a first embodiment of the present application.

Figure 7:
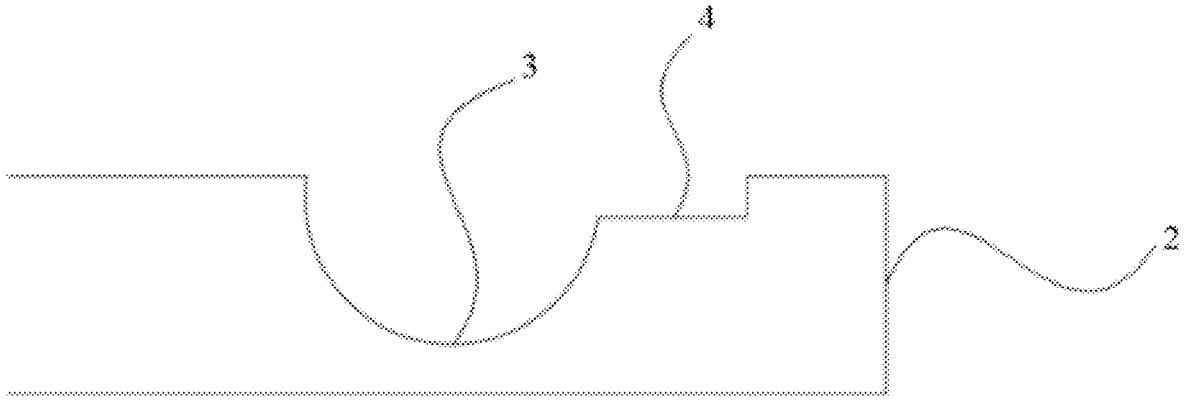

FIG. 7 is a schematic structural diagram of a first sealant groove and a second sealant groove according to a second embodiment of the present application.

Figure 8:
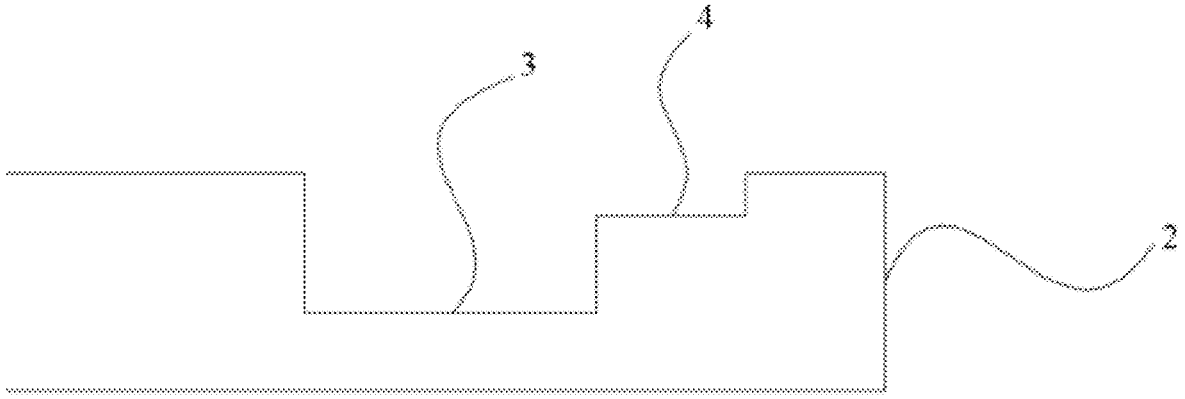

FIG. 8 is a schematic structural diagram of a first sealant groove and a second sealant groove according to a third embodiment of the present application.

Figure 9:
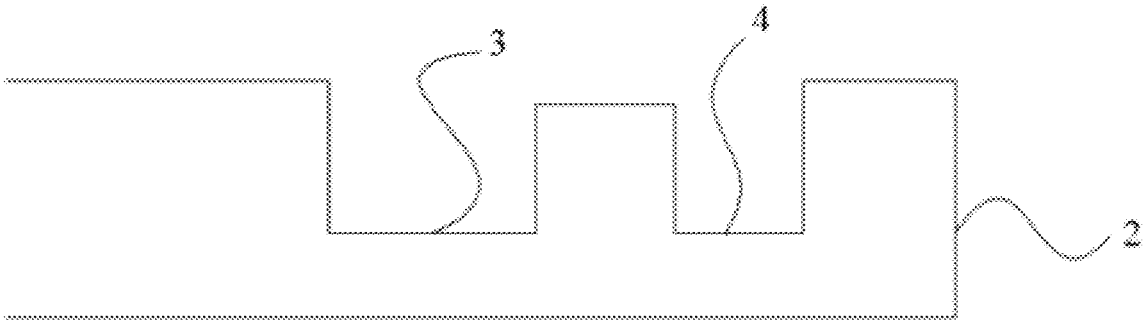

FIG. 9 is a schematic structural diagram of a first sealant groove and a second sealant groove according to a fourth embodiment of the present application.

Figure 10:
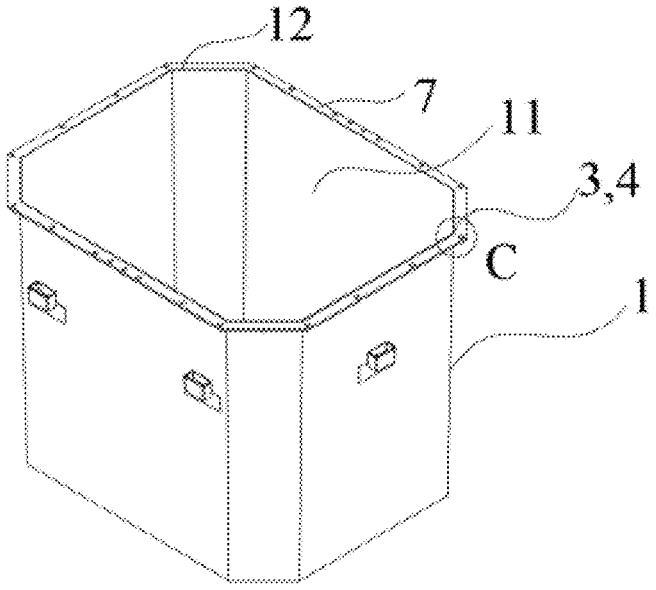

FIG. 10 is a schematic structural diagram of a cover according to an embodiment of the present application.

Figure 11:
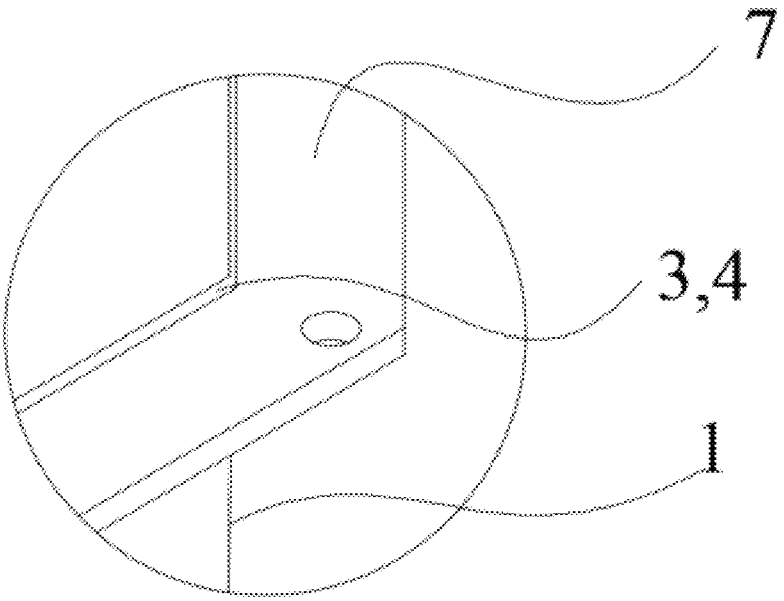

FIG. 11 is an enlarged view of part C in FIG. 10.

Figure 12:
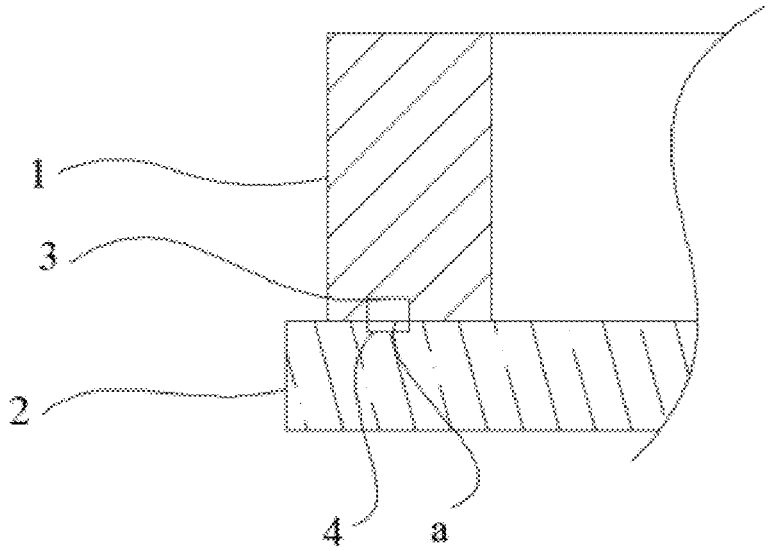

FIG. 12 is a first schematic structural diagram of a first sealant groove and a second sealant groove arranged in a cover and a supporting plate respectively, according to an embodiment of the present application.

Figure 13:
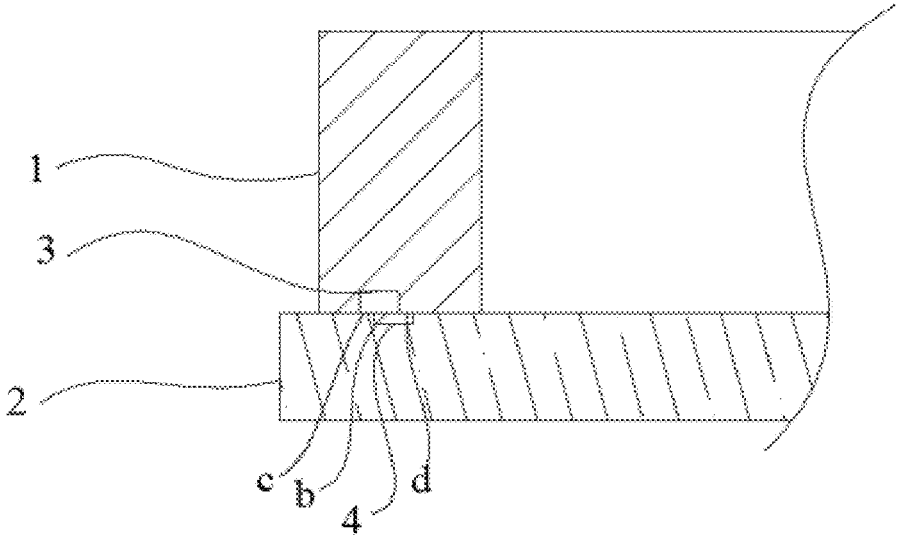

FIG. 13 is a second schematic structural diagram of a first sealant groove and a second sealant groove arranged on a cover and a supporting plate respectively, according to an embodiment of the present application.

Figure 14:
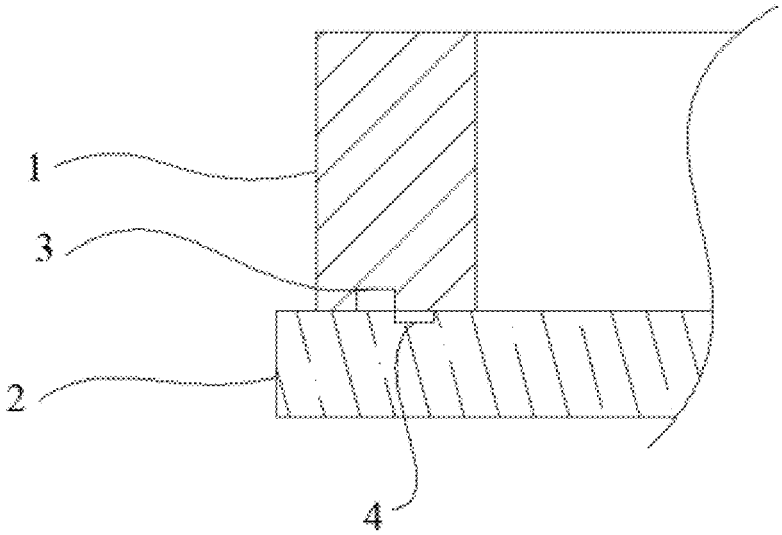

FIG. 14 is a third schematic structural diagram of a first sealant groove and a second sealant groove arranged on a cover and a supporting plate respectively, according to an embodiment of the present application.

Figure 15:
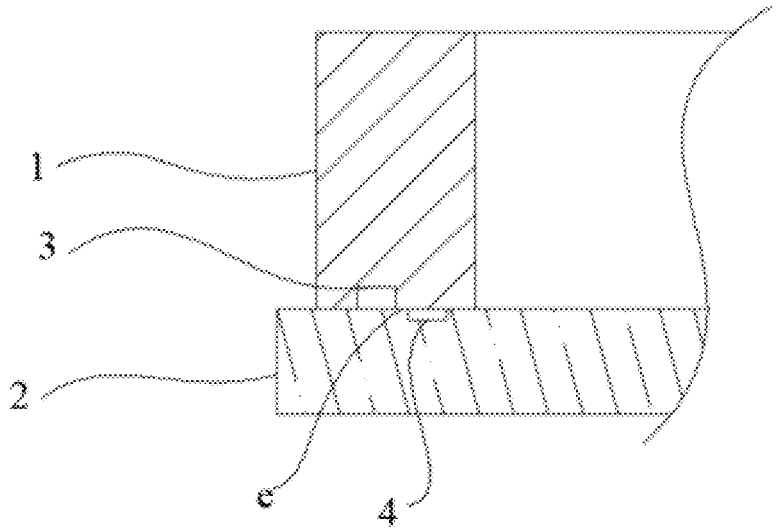

FIG. 15 is a fourth schematic structural diagram of a first sealant groove and a second sealant groove arranged on a cover and a supporting plate respectively, according to an embodiment of the present application.

LIST OF REFERENCE SIGNS

1—Cover, 2—Supporting plate, 3—First sealant groove, 4—Second sealant groove, 5—Insertion element, 6—Locking mechanism, 7—Connector, 11—Opening, 12—Open end, a—First overlapping region, b—Second overlapping region, c—First staggered region, d—Second staggered region, e—Middle region.

DETAILED DESCRIPTION

In order to make the objectives, technical solutions and advantages of embodiments of the present application clearer, the technical solutions in the embodiments of the present application will be described clearly and completely below with reference to the accompanying drawings in the embodiments of the present application. Apparently, the embodiments described are some of, rather than all of, the embodiments of the present application. All other embodiments obtained by those of ordinary skill in the art on the basis of the embodiments of the present application without involving any inventive effort shall fall within the scope of protection of the present application.

Unless otherwise defined, all technical and scientific terms used herein have the same meanings as those commonly understood by those skilled in the art to which the present application belongs. The terms used in the description of the present application are merely for the purpose of describing specific embodiments, and are not intended to limit the present application.

The terms "include/comprise" and "have" in the description, claims and drawings of the present application and any variations thereof are intended to cover and not exclude other contents. The word "a/an" or "one" does not exclude plural.

The phrase "an embodiment" mentioned herein means that the specific features, structures, or characteristics described with respect to the embodiment can be encompassed in at least one embodiment of the present application. The phrase "embodiment" in various places in the description does not necessarily refer to the same embodiment, nor is it an independent or alternative embodiment exclusive of other embodiments. Those skilled in the art understand explicitly or implicitly that the embodiment described herein may be combined with another embodiment.

The term "and/or" herein is merely the description of an associated relationship of associated objects, and indicates that three relationships may exist. For example, A and/or B can indicate only A exists, both A and B exist, and only B exists. In addition, the character "/" herein generally indicates an "or" relationship between the associated objects.

The orientation terms in the following description all indicate directions shown in the accompanying drawings, and do not limit a specific structure of a storage and transportation device of the present application. For example, in the description of the present application, the orientation or positional relationships indicated by the terms "central", "longitudinal", "transverse", "length", "width", "thickness", "upper", "lower", "front", "rear", "left", "right", "vertical", "horizontal", "top", "bottom", "inner", "outer", "clockwise", "anticlockwise", "axial", "radial", "circumferential", etc. are based on the orientation or positional relationships shown in the accompanying drawings and are merely for ease of description of the present application and for simplicity of description, rather than indicating or implying that the device or element referred to must have a particular orientation or be constructed and operated in a particular orientation, and thus cannot be construed as a limitation on the present application.

In addition, expressions indicating directions, such as an X-direction, a Y-direction and a Z-direction, which are used to describe operations and configurations of various members of the storage and transportation device of the embodiments, are not absolute but relative, and although the indications are appropriate when various members of a battery pack are in positions shown in the figures, when the positions are changed, the directions should be interpreted differently to correspond to the changes.

In addition, the terms "first", "second", etc. in the description, claims, or the accompanying drawings of the present application are used for distinguishing different objects, instead of describing a specific order, and thus can explicitly or implicitly include one or more features.

In the description of the present application, unless otherwise stated, "a plurality of" means two or more (including two), and similarly, "a plurality of groups" means two or more groups (including two groups).

In the description of the present application, it should be noted that unless otherwise explicitly specified and defined, the terms "mounting", "connected", and "connection" should be understood in a broad sense. For example, "connected" or "connection" of mechanical structures can be a physical connection. For example, the physical connection can be a fixed connection, by means of, for example, a fixing member, such as a screw, a bolt, etc.; or the physical connection can be a detachable connection, for example, a mutual snap-fit or bayonet connection; or the physical connection can be an integral connection, for example, welding, bonding, or integral molding. In addition to a physical connection, "connected" or "connection" of circuit structures can be an electrical connection or a signal connection. For example, it can be a direct connection, that is, the physical connection, or an indirect connection by means of at least one intermediate element, as long as the circuits are connected. It can further be internal communication between two elements. In addition to a signal connection by means of a circuit, the signal connection can be a signal connection by means of a media medium, such as radio waves. For those of ordinary skill in the art, the specific meanings of the terms in the present application can be construed according to specific circumstances.

Electrode plates are important constituent components of secondary batteries, which involve a very important process during production of the secondary batteries, and are the core parts of the secondary batteries. During the production of the secondary batteries, a plurality of turnaround operation steps, such as storage, transportation, etc., are required for the electrode plates. In these turnaround operation steps, if the moisture content in an electrode plate is too high, a current collector will be corroded; also, moisture remaining on the electrode plate may cause that an electrolyte absorbs the moisture and is decomposed, and hydrogen fluoride (HF) is thus generated, which corrodes the electrode plate, finally deteriorates the cycling performance of the secondary battery, or even results in a safety accident.

In related art, electrode plates are stored and transported by using a storage and transportation device. The storage and transportation device includes a box body provided with two upright doors, the two upright doors are opened to allow the electrode plates to be placed on a supporting structure in the box body, and the two upright doors are closed to seal the box body after the electrode plates are placed in place. There is a crack between the two upright doors, a seal ring for a fitting surface is made of rubber or silicone in the related art, and the crack is sealed by compressing the rubber or silicone when the two upright doors are closed. In addition, in the related art, a desiccant is further placed at an inner bottom of the box body, and the environment in the box body is dried by the desiccant such as phosphorus pentoxide, so that the electrode plates are prevented from absorbing moisture during storage and transportation.

The applicants have found that in the related art, the upright doors are sealed by the seal ring, a plurality of gaps exist between the seal ring and the upright doors and provide an access for moisture outside the box body to enter the box body, and the moisture outside the box body can enter the box body through the access. Therefore, the storage and transportation device has a poor sealing performance and cannot effectively isolate moisture. In addition, in the related art, the moisture in the box body is controlled by means of a desiccant placed in the box body, but the desiccant can keep the box body dry for only a short time. During prolonged storage and transportation, both the electrode plates and the desiccant in the box body absorb the moisture in the box body. When the moisture absorbed reaches an upper limit of the desiccant, the moisture in the box body will be absorbed by the electrode plates, causing the electrode plates to absorb excess moisture. Therefore, the placement of the desiccant cannot ensure that the humidity in the box body remains constant for a long time, and the moisture absorbed by the electrode plates cannot be controlled effectively. In conclusion, the storage and transportation device provided in the related art cannot effectively isolate moisture, and cannot guarantee prolonged dry storage and transportation of electrode plates.

In view of this, the embodiments of the present application provide a storage and transportation device in which a first sealant groove is arranged at a sealed junction between a cover and a supporting plate, and part of a sealant is accommodated in each of the first sealant groove and the second sealant groove. In the present application, a gap between the cover and the supporting plate is sealed by means of the parts of the sealant connected, which effectively cuts off a passage of moisture, reduces the possibility of moisture in the ambient environment entering the storage and transportation device, thereby achieving a good sealing effect to ensure that the humidity in the storage and transportation device is constant. In the present application, the control of the humidity in the storage and transportation device does not rely on a desiccant, so the storage and transportation device is suitable for prolonged dry storage and transportation.

The storage and transportation device provided in the embodiments of the present application can be used to store any item to be transported that have a requirement for moisture content. For example, the item to be transported may be an electrode plate. The electrode plate may be a positive electrode plate or a negative electrode plate in a secondary battery, and the secondary battery may be a single physical module comprising one or more battery cells to provide a higher voltage and capacity. For example, the secondary battery mentioned in the present application may comprise a battery module, a battery pack, etc. The secondary battery mentioned in the present application may be a prismatic battery, a cylindrical battery, etc. The secondary battery may be configured to supply power to a power consuming device. The power consuming device may be a vehicle, a mobile phone, a portable device, a notebook computer, a ship, a spacecraft, an electric toy, an electric tool, etc. The vehicle may be a fuel vehicle, a gas vehicle or a new energy vehicle. The new energy vehicle may be a battery electric vehicle, a hybrid vehicle, an extended range vehicle, etc. The spacecraft includes an airplane, a rocket, an aerospace plane, a spaceship, etc. The electric toy includes a stationary or mobile electric toy, such as a game machine, an electric toy car, an electric toy ship, and an electric toy airplane. The electric tool includes a metal cutting electric tool, a grinding electric tool, an assembling power tool, and a railway power tool, such as an electric drill, an electric grinder, an electric wrench, an electric screwdriver, an electric hammer, an electric impact drill, a concrete vibrator, and an electric planer. The foregoing power consuming devices are not specifically limited in the embodiments of the present application.

The storage and transportation device provided in the embodiments of the present application will be described below in detail with reference to the accompanying drawings. FIG. 1 is a schematic structural diagram of a storage and transportation device according to an embodiment of the present application, FIG. 2 is an enlarged view of part A of FIG. 1, FIG. 3 is a schematic structural diagram of another storage and transportation device according to an embodiment of the present application, FIG. 4 is a schematic structural diagram of a supporting plate 2 according to an embodiment of the present application, FIG. 5 is an enlarged view of part B in FIG. 4, and FIGS. 6 to 9 are schematic structural diagrams of first sealant grooves 3 and second sealant grooves 4 according to four embodiments of the present application.

As shown in FIGS. 1 to 9, the present application provides a storage and transportation device, comprising: a cover 1, a supporting plate 2 and a sealant. The cover 1 has an opening 11, and the supporting plate 2 covers the opening 11 to form a space for accommodating an item to be transported. The storage and transportation device further comprises a first sealant groove 3 and a second sealant groove 4, wherein the first sealant groove 3 is arranged at a sealed junction between the cover 1 and the supporting plate 2; the sealant comprises a first part and a second part, the first part and the second par are respectively located in the first sealant groove 3 and the second sealant groove 4, the first part is connected to the second part, and the sealant is used to seal the cover 1 and the supporting plate 2.

The cover 1 is a component that cooperates with the supporting plate 2 to form the space for accommodating the item to be transported. The cover 1 may be a hollow structure having an opening at one end, and the cover 1 may be in the form of a cuboid, a square, a cylinder, a hexagonal prism, etc., which is not limited in the embodiments of the present application. The cover 1 may be formed by assembling a plurality of plates, and the cover 1 may also be integrally formed in order to eliminate gaps generated during assembling, which provide an access for moisture to enter. The cover 1 may be sized depending on the size of the item to be transported. The item to be transported may be any article having a requirement for moisture content, for example, the item to be transported may be an electrode plate of a secondary battery, and the electrode plate may be a positive electrode plate or a negative electrode plate. The cover 1 may be made of various materials, such as ABS, rubber, etc., and in order to further improve the sealing performance of the storage and transportation device, the cover 1 may also be made of a metal material with lower water permeability.

The supporting plate 2 is of a plate-shaped structure, the supporting plate 2 may be in the form of a cuboid, a square, cylinder, etc., and the shape of the supporting plate 2 and the shape of a cross section of the cover 1 may be the same, of course, or may be different. A surface of the supporting plate 2 may be greater than the opening 11 of the cover 1 in size, such that the supporting plate 2 can completely block the opening 11 when covering an open end 12 of the cover 1, so as to form the space for accommodating the item to be transported. The supporting plate 2 may also be made of ABS, rubber, etc., and in order to further improve the sealing performance of the storage and transportation device, the supporting plate 2 may also be made of a metal material with lower water permeability. When the cover 1 and the supporting plate 2 are both made of the metal material, the sealing level of the storage and transportation device can reach such a higher sealing level that moisture can be prevented from entering the storage and transportation device in terms of material, achieving a better sealing effect.

The sealed junction between the cover 1 and the supporting plate 2 refers to a contact surface of the cover 1 in contact with the supporting plate 2 and a contact surface of the supporting plate 2 in contact with the cover 1. As shown in FIGS. 2, 4 to 7, the first sealant groove 3 and the second sealant groove 4 may be both arranged at the sealed junction between the cover 1 and the supporting plate 2. As shown in FIGS. 6 to 9, the first sealant groove 3 and the second sealant groove 4 may be square grooves, circular grooves, trapezoidal grooves, etc., and the shape of the first sealant groove 3 may be the same as or different from the shape of the second sealant groove 4, which is not limited in the embodiments of the present application. The first sealant groove 3 and the second sealant groove 4 may be configured to be wide in order to increase the sealing area of the sealed junction, thereby improving the sealing performance of the storage and transportation device, and the first sealant groove 3 and the second sealant groove 4 may be configured to have a small depth such that the first sealant groove 3 and the second sealant groove 4 can be easily filled with the sealant, and the amount of the sealant used can also be saved. The width of the first sealant groove 3 refers to a distance between two walls of the first sealant groove 3, and the width of the second sealant groove 4 refers to a distance between two walls of the second sealant groove 4. The depth of the first sealant groove 3 refers to a distance between an opening and a bottom of the first sealant groove 3, and the depth of the second sealant groove 4 refers to a distance between an opening and a bottom of the second sealant groove 4.

The first part of the sealant can be contained in the first sealant groove 3, the second part of the sealant can be contained in the second sealant groove 4, and the first part of the sealant being connected to the second part of the sealant means that the first part of the sealant is in contact with the second part of the sealant. Exemplarily, the first part of the sealant may be connected directly to the second part of the sealant, that is, the sealant in the first sealant groove 3 is in direct contact with the sealant in the second sealant groove 4. The first part of the sealant may also be connected indirectly to the second part of the sealant, in this case, the first part of the sealant may be connected indirectly to the second part of the sealant by the sealant applied to the contact surface of the cover 1 and/or the supporting plate 2, or by the sealant overflowing from the first sealant groove 3 and/or the sealant overflowing from the second sealant groove 4, which is not limited in the embodiments of the present application.

The sealant may be any kind of sealant. Different kinds of sealants have different water permeability coefficients, and therefore the sealant can be selected based on the moisture content requirement of the item to be transported. For example, if the item to be transported has a higher requirement for moisture content, a sealant with a smaller water permeability coefficient may be selected; and if the item to be transported has a lower requirement for moisture content, a sealant with a larger water permeability coefficient may be selected. In order to ensure that the storage and transportation device has a good sealing performance, both the first sealant groove 3 and the second sealant groove 4 may be fully filled with the sealant, and the sealant may be applied at both the open end 12 of the cover 1 and other contact portions of the supporting plate 2. In this way, when the cover 1 covers the supporting plate 2, these parts of the sealant can be compressed, such that the sealant is uniformly distributed in the gaps, and a sealing function can be served by fully filling the gaps with the sealant.

In the storage and transportation device provided by the embodiments of the present application, the supporting plate 2 covers the open end 12 of the cover 1 to form the space for accommodating the item to be transported. In the entire device, a gap may exist at only the sealed junction between the cover 1 and the supporting plate 2. According to the present application, the first sealant groove 3 and the second sealant groove 4 are arranged at the sealed junction between the cover 1 and the supporting plate 2, and the sealant is contained in each of the two sealant grooves, and the sealant in the two sealant grooves is connected, that is to say, the gap between the cover 1 and the supporting plate 2 is sealed by the connected sealant in the present application, effectively cutting off the passage for moisture, reducing the possibility of moisture in the ambient environment entering the storage and transportation device, thereby achieving a good sealing effect to ensure that the humidity in the storage and transportation device is not affected by the ambient environment. In the present application, the control of the humidity in the storage and transportation device does not rely on a desiccant, so the storage and transportation device is suitable for prolonged dry storage and transportation.

In some embodiments, as shown in FIG. 2 and FIGS. 6 to 9, the first sealant groove 3 is in communication with the second sealant groove 4.

Both the first sealant groove 3 and the second sealant groove 4 have an opening and walls. In some possible cases, as shown in FIGS. 2, 6 and 8, the first sealant groove 3 may be in direct communication with the second sealant groove 4. Exemplarily, Referring to FIGS. 2, 6 and 8, the opening of the first sealant groove 3 is in communication with the opening of the second sealant groove 4, or a wall of the first sealant groove 3 is in communication with a wall of the second sealant groove 4. The walls of the first sealant groove 3 and the second sealant groove 4 may each be provided with a through hole, and the wall of the first sealant groove 3 communicates with the wall of the second sealant groove 4 via the through holes in the walls of the first sealant groove 3 and the second sealant groove 4.

In some other possible cases, as shown in FIG. 9, the first sealant groove 3 may be in indirect communication with the second sealant groove 4 via the gap between the cover 1 and the supporting plate 2.

Regardless of which way of communication between the first sealant groove 3 and the second sealant groove 4, the sealant in the first sealant groove 3 can flow into the second sealant groove 4, and the sealant in the second sealant groove 4 can also flow into the first sealant groove 3. In this way, during sealant application, the sealant can be applied to only the first sealant groove 3, and the sealant in the first sealant groove 3 can overflow to the second sealant groove 4 after the first sealant groove is fully filled with the sealant. It is also possible to apply the sealant to only the second sealant groove 4, and the sealant in the second sealant groove 4 can overflow to the first sealant groove 3 after the second sealant groove is fully filled with the sealant. Of course, it is also possible to apply the sealant to both the first sealant groove 3 and the second sealant groove 4, which is not limited in the embodiments of the present application.

The first sealant groove 3 is in communication with the second sealant groove 4, such that the sealant in the first sealant groove 3 and the sealant in the second sealant groove 4 can be in communication with each other. When the cover 1 covers the supporting plate 2, the sealant overflowing from the first sealant groove 3 can flow to the second sealant groove 4, and the sealant overflowing from the second sealant groove 4 can also flow to the first sealant groove 3, facilitating that the sealant is remained in the gap between the cover 1 and the supporting plate 2 and thus is not compressed out of the gap, thereby facilitate improvement of the sealing performance of the storage and transportation device.

In some embodiments, as shown in FIGS. 10 and 11, both the first sealant groove 3 and the second sealant groove 4 are arranged at the open end 12 of the cover 1 in a circumferential direction of the cover 1.

The open end 12 of the cover 1 is an end of the cover 1 facing the supporting plate 2, and the open end 12 of the cover 1 may be in the form of a rectangle, a square, a circle, etc. The shapes of the first sealant groove 3 and the second sealant groove 4 may be the same as or different from the shape of the open end 12 of the cover 1, which is not limited in the embodiments of the present application. In order to ensure that all parts at the sealed junction have a good sealing performance, the open end 12 of the cover 1 can be provided with the first sealant groove 3 and the second sealant groove 4 along the entire circumference of the cover 1 in the circumferential direction, that is to say, the first sealant groove 3 and the second sealant groove 4 may be annular grooves arranged at the open end 12 of the cover 1.

The second sealant groove 4 may be located on an inner side of the first sealant groove 3 or an outer side of the first sealant groove 3, which is not limited in the embodiments of the present application. The inner side refers to a side close to an interior of the storage and transportation device, and the outer side refers to a side away from the interior of the storage and transportation device.

The first sealant groove 3 and the second sealant groove 4 may be arranged directly adjacent to each other, in other words, the first sealant groove 3 and the second sealant groove 4 may have a common wall. In this case, the sealant in the first sealant groove 3 may be directly connected to the sealant in the second sealant groove 4. The first sealant groove 3 may also be at distance from the second sealant groove 4 which may be set depending on the wall thickness of the cover 1. In this case, the sealant in the first sealant groove 3 may be indirectly connected to the sealant in the second sealant groove 4 by the sealant applied to the contact surface of the cover 1 and/or the supporting plate 2, or by the sealant overflowing from the first sealant groove 3 and/or the sealant overflowing from the second sealant groove 4.

The first sealant groove 3 and the second sealant groove 4 are both arranged in the open end 12 of the cover 1 in the circumferential direction of the cover 1, which provides an arrangement of the first sealant groove 3 and the second sealant groove 4. The two sealant grooves each contain the sealant, the sealant in the two sealant grooves are connected, and the sealant connected is filled in the gap at the sealed junction between cover 1 and supporting plate 2 to seal the gap, thereby lengthening a water permeation path between the cover 1 and the supporting plate 2, effectively cutting off the passage for moisture, and reducing the possibility of moisture entry to ensure that the humidity in the storage and transportation device remains constant.

In some embodiments, as shown in FIG. 2 and FIGS. 4 to 9, both the first sealant groove 3 and the second sealant groove 4 are arranged on the supporting plate 2 in the circumferential direction of the cover 1.

The shapes of the first sealant groove 3 and the second sealant groove 4 may be the same as the shapes of the first sealant groove 3 and the second sealant groove 4 in the preceding embodiments. A relative positional relationship between the first sealant groove 3 and the second sealant groove 4 may be the same as a relative positional relationship between the first sealant groove 3 and the second sealant groove 4 in the preceding embodiments. A difference from the preceding embodiments lies in that the first sealant groove 3 and the second sealant groove 4 in this embodiment are arranged at a portion of the supporting plate 2 which is in contact with the open end 12 of the cover 1.

This embodiment provides another arrangement of the first sealant groove 3 and the second sealant groove 4. The supporting plate 2 has a large plate surface, and the first sealant groove 3 and the second sealant groove 4 are provided on the supporting plate 2, thereby reducing the risk that it is difficult to provide the first sealant groove 3 and the second sealant groove 4 both on the open end of the cover due to a limited size of the open end 12 of the cover 1 at the sealed junction.

In some embodiments, as shown in FIGS. 12 to 15, one of the first sealant groove 3 and the second sealant groove 4 is arranged on the open end 12 of the cover 1 in the circumferential direction of the cover 1, and the other one of the first sealant groove 3 and the second sealant groove 4 is arranged on the supporting plate 2 in the circumferential direction of the cover 1.

The shapes of the first sealant groove 3 and the second sealant groove 4 may be the same as the shapes of the first sealant groove 3 and the second sealant groove 4 in the preceding two embodiments.

A difference from the preceding two embodiments lies in that the first sealant groove 3 and the second sealant groove 4 in this embodiment are located on the open end 12 of the cover 1 and the supporting plate 2 respectively. In this embodiment, the first sealant groove 3 may face or partially or completely staggered with the second sealant groove 4.

As shown in FIG. 12, the first sealant groove 3 face the second sealant groove 4, the sealant in the first sealant groove 3 and the sealant in the second sealant groove 4 has a first overlapping region a at the sealed junction, and the sealant in the first sealant groove 3 and the sealant in the second sealant groove 4 can seal the gap at the sealed junction where the first overlapping region a is located.

As shown in FIG. 13, the first sealant groove 3 is partially staggered with the second sealant groove 4, the sealant in the first sealant groove 3 and the sealant in the second sealant groove 4 have a second overlapping region b, a first staggered region c, and a second staggered region d at the sealed junction, and the sealant in the first sealant groove 3 and the sealant in the second sealant groove 4 can seal the gap at the sealed junction where the second overlapping region b, the first staggered region c and the second staggered region d are located, increasing a sealing range of the sealant. The first staggered region c is a portion of the first sealant groove 3 exposed from the second sealant groove 4, and the second staggered region d is a portion of the second sealant groove 4 exposed from the first sealant groove 3.

As shown in FIG. 14, the first sealant groove 3 is completely staggered with the second sealant groove 4, and the first sealant groove 3 is arranged directly adjacent to the second sealant groove 4, the sealant in the first sealant groove 3 is directly connected to the sealant in the second sealant groove 4, and the sealant in the first sealant groove 3 and the sealant in the second sealant groove 4 can seal the gap at the sealed junction that corresponds to the first sealant groove 3 and the second sealant groove 4, further increasing the sealing range of the sealant.

As shown in FIG. 15, the first sealant groove 3 is completely staggered with the second sealant groove 4, and the first sealant groove 3 is arranged at a distance from the second sealant groove 4, the sealant in the first sealant groove 3 is indirectly connected to the sealant in the second sealant groove 4 by the sealant in a middle region e, and the sealant in the first sealant groove 3, the sealant in the middle region e and the sealant in the second sealant groove 4 can seal the gaps at sealed junction that correspond to the first sealant groove 3, the middle region e and the second sealant groove 4, further increasing the sealing range of the sealant. The middle region e is a region of the sealed junction between the first sealant groove 3 and the second sealant groove 4, and the sealant in the middle region e refers to the sealant applied to the contact surface of the cover 1 and/or the supporting plate 2, or the sealant overflowing from the first sealant groove 3 and/or the sealant overflowing from the second sealant groove 4.

This embodiment provides yet another arrangement of the first sealant groove 3 and the second sealant groove 4, in which the first sealant groove 3 and the second sealant groove 4 are arranged on the open end 12 of the cover 1 and the supporting plate 2 respectively, thereby reducing the risk that the first sealant groove 3 and the second sealant groove 4 cannot be both arranged on the open end of the cover or on the supporting plate due to the limited size of the open end 12 of the cover 1 or of the supporting plate 2 at the sealed junction, and also avoiding an substandard strength of the cover 1 or the supporting plate 2 due to the arrangement of both the first sealant groove 3 and the second sealant groove 4 on the cover 1 or on the supporting plate 2.

In some embodiments, a plurality of second sealant grooves 4 are provided, and the plurality of sealant grooves 4 are staggered with each other.

A plurality of second sealant grooves 4 are provided, regardless of whether the first sealant groove 3 and the second sealant groove 4 are arranged on the open end 12 of the cover 1 or on the supporting plate 2, and regardless of the relative positional relationship between the first sealant groove 3 and the second sealant groove 4.

The plurality of second sealant grooves 4 are staggered with each other. If the plurality of second sealant grooves 4 are all fully filled with the sealant, the sealant in the plurality of second sealant grooves 4 will remain at different positions in the gap between the cover 1 and the supporting plate 2, so that the sealing area at the sealed junction can be increased, which is beneficial to improving the sealing performance of the storage and transportation device.

It is worth noting that no matter how many first sealant grooves 3 and second sealant grooves 4 are provided, and no matter whether the first sealant grooves 3 and the second sealant grooves 4 are arranged on the cover 1 or on the supporting plate 2, both the first sealant grooves 3 and the second sealant grooves 4 may be staggered from each other. In this way, after the first sealant grooves 3 and the second sealant grooves 4 are all fully filled with the sealant and the cover 1 covers the supporting plate 2, when the sealant in all the first sealant grooves 3 and the second sealant grooves 4 is connected, the connected sealant can increase the sealing area between the cover 1 and the supporting plate 2, effectively cut off the passage for moisture, and reduce the possibility of moisture entry to ensure that the humidity in the storage and transportation device remains constant.

In some embodiments, when a plurality of second sealant grooves 4 are provided, the second sealant grooves 4 may be arranged on only the open end 12 of the cover 1.

In this embodiment, the first sealant groove 3 and the plurality of second sealant grooves 4 may be both located on the open end 12 of the cover 1. Alternatively, the first sealant groove 3 is located in the supporting plate 2, and the plurality of second sealant grooves 4 are all located on the open end 12 of the cover 1.

In some embodiments, when a plurality of second sealant grooves 4 are provided, the second sealant grooves 4 may be arranged on only the supporting plate 2.

In this embodiment, the first sealant groove 3 and the plurality of second sealant grooves 4 may be both located on the supporting plate 2. Alternatively, the first sealant groove 3 is located in the open end 12 of the cover 1, and the plurality of second sealant grooves 4 are all located on the supporting plate 2.

In some embodiments, when a plurality of second sealant grooves 4 are provided, the second sealant grooves 4 may be arranged on each of the open end 12 of the cover 1 and the supporting plate 2.

In this embodiment, the first sealant groove 3 and some of the second sealant grooves 4 may be located on the open end 12 of the cover 1, and the remaining second sealant grooves 4 are located on the supporting plate 2. Alternatively, the first sealant groove 3 and part of the second sealant grooves 4 may be located on the supporting plate 2, and the remaining second sealant grooves 4 are located at the open end 12 of the cover 1.

The foregoing embodiments provide several flexible and diverse manners of arranging the first sealant groove 3 and the plurality of second sealant grooves 4 when the plurality of second sealant grooves 4 are provided. The open end 12 of the cover 1 and the supporting plate 2 are both provided with the second sealant grooves 4, that is, the second sealant grooves 4 are all arranged on the open end 12 of the cover 1 and the supporting plate 2, thereby reducing the risk that the plurality of second sealant grooves 4 cannot be arranged on the open end of the cover or on the supporting plate due to the limited size of the open end 12 of the cover 1 or of the supporting plate 2 at the sealed junction, and also avoiding an substandard strength of the cover 1 or the supporting plate 2 due to the arrangement of all of the plurality of second sealant grooves 4 on the cover 1 or the supporting plate 2.

In some embodiments, as shown in FIG. 2, an insertion element 5 is further arranged at the sealed junction. The insertion element 5 has a first end and a second end opposite to each other, wherein the first end is connected to the cover 1 or the supporting plate 2, and the second end extends into the first sealant groove 3.

When the first sealant groove 3 is arranged on the supporting plate 2, and the insertion element 5 is arranged facing the first sealant groove 3 on the open end 12 of the cover 1, the first end of the insertion element 5 is connected to the cover 1, and the second end extends into the first sealant groove 3. When the second sealant groove 4 is arranged facing the first sealant groove 3 on the open end 12 of the cover 1, the insertion element 5 may be arranged in the second sealant groove 4; and when no second sealant groove 4 is arranged facing the first sealant groove 3 on the open end 12 of the cover 1, the insertion element 5 may also be arranged at a position on the open end 12 of the cover 1 where no second sealant groove 4 is provided.

When the first sealant groove 3 is arranged on the open end 12 of the cover 1, and the insertion element 5 is arranged facing the first sealant groove 3 on the supporting plate 2, the first end of the insertion element 5 is connected to the supporting plate 2, and the second end extends into the first sealant groove 3. When the second sealant groove 4 is arranged facing the first sealant groove 3 on the supporting plate 2, the insertion element 5 may be arranged in the second sealant groove 4; and when no second sealant groove 4 is arranged facing the first sealant groove 3 on the supporting plate 2, the insertion element 5 may also be arranged at a position on the supporting plate 2 where no second sealant groove 4 is provided.

The insertion element 5 is arranged at the sealed junction, and the first end of the insertion element 5 is connected to the cover 1 or the supporting plate 2. When the cover 1 covers the supporting plate 2, on the one hand, the second end of the insertion element 5 extends into the first sealant groove 3 to compress the sealant in the first sealant groove 3 such that the sealant in the first sealant groove 3 readily overflows to the sealed junction to increase the amount of the sealant accumulated at the sealed junction, thereby improving the sealing effect of the storage and transportation device. On the other hand, the insertion element 5 extends into the first sealant groove 3, and a side wall of the insertion element 5 is covered with the sealant, such that ambient moisture may enter the storage and transportation device only by bypassing the insertion element 5. It can be seen that an original linear water permeation path can be changed into a curved water permeation path by arranging the insertion element 5, lengthening the water permeation path at the sealed junction, effectively cutting off the passage for moisture, and reducing the possibility of moisture entry to ensure that the humidity in the storage and transportation device remains constant. The water permeation path refers to a route through which moisture in the ambient environment enters the storage and transportation device.

It should be noted here that the second end of the insertion element 5 extends into the second sealant groove 4, and the above effect can also be achieved by compressing the sealant in the second sealant groove 4. When the second end of the insertion element 5 extends into the second sealant groove 4 on the open end 12 of the cover 1, the insertion element 5 may be arranged in the first sealant groove 3 facing the second sealant groove 4 or the second sealant groove 4 arranged on the supporting plate 2, or may be arranged at a position on the supporting plate 2 where neither of the first sealant groove 3 and the second sealant groove 4 is provided. When the second end of the insertion element 5 extends into the second sealant groove 4 on the supporting plate 2, the insertion element 5 may be arranged in the first sealant groove 3 facing the second sealant groove 4 or the second sealant groove 4 arranged on the open end 12 of the cover 1, or may also be arranged at a position on the open end 12 of the cover 1 where neither of the first sealant groove 3 and the second sealant groove 4 are provided, which is not limited in the embodiments of the present application.

In some embodiments, as shown in FIG. 2, the insertion element 5 is an annular structure extending in the circumferential direction of the cover 1, and the insertion element 5 is connected to the cover 1 or the supporting plate 2.

On the basis of the preceding embodiments, the insertion element 5 may be arranged on the open end 12 of the cover 1 or the supporting plate 2, or may be arranged in the first sealant groove 3 or the second sealant groove 4. Therefore, the insertion element 5 can be an annular protrusion arranged from the open end 12 of the cover 1 towards the supporting plate 2 in the circumferential direction of the cover 1, or an annular protrusion arranged from the supporting plate 2 towards the cover 1, or an annular protrusion arranged from the bottom to the opening of the first sealant groove 3, or is an annular protrusion arranged from the bottom to the opening of the second sealant groove 4.

The insertion element 5 is configured as an annular structure extending in the circumferential direction of the cover 1, the first end of the insertion element 5 is connected to the cover 1 or the supporting plate 2, and the second end extends into the first sealant groove 3 or the second sealant groove 4. When the cover 1 covers the supporting plate 2, on the one hand, the insertion element 5 can compress the sealant in the first sealant groove 3 or the second sealant groove 4 at various positions in the circumferential direction of the cover 1 to cause the sealant in the first sealant groove 3 or the second sealant groove 4 to readily overflow to the sealed junction, thereby improving the sealing effect of the sealant. On the other hand, the insertion element 5 can extend into the first sealant groove 3 or the second sealant groove 4 along the entire circumference of the cover 1 in the circumferential direction, and the ambient moisture along the entire circumference of the cover 1 in the circumferential direction may enter the storage and transportation device only by bypassing the second end of the insertion element 5, so that the insertion element 5 can lengthen the water permeation path at various positions in the circumferential direction of the cover 1, further effectively cut off the passage for moisture, and reduce the possibility of moisture entry to ensure that the humidity in the storage and transportation device remains constant.

In some embodiments, as shown in FIG. 2, when the second end of the insertion element 5 extends into the first sealant groove 3, there may be a spacing between the second end of the insertion element 5 and the bottom of the first sealant groove 3.

If the second end of the insertion element 5 extends into the first sealant groove 3 and then comes into contact with the bottom of the first sealant groove 3, that is, if there is no spacing between the second end of the insertion element 5 and the bottom of the first sealant groove 3, there is no sealant at the position where the second end of the insertion element 5 is in contact with the bottom, the water permeation path will be interrupted at this position, and moisture may permeate here. However, if there is a spacing between the second end of the insertion element 5 and the bottom of the first sealant groove 3, the spacing may be filled with the sealant, such that the water permeation path will not be interrupted therefrom. Therefore, it is necessary to provide a spacing between the second end of the insertion element 5 and the bottom of the first sealant groove 3.

For example, the spacing may be 2 mm, 5 mm, etc., which is not limited in the embodiments of the present application. However, in the case of the first sealant groove 3 having a constant depth, the deeper the second end of the insertion element 5 is inserted into the first sealant groove 3, that is, the smaller the spacing between the second end of the insertion element 5 and the groove bottom of the first sealant groove 3, the longer the route that moisture needs to pass through for permeation, and the more water permeation path can be lengthened by the arrangement of the insertion element 5. Therefore, the spacing may be set as small as possible.

When the second end of the insertion element 5 extends into the first sealant groove 3, there is a spacing between the second end of the insertion element 5 and the groove bottom of the first sealant groove 3, such that the water permeation path is not interrupted at this spacing, and thus the effect of the improvement of the sealing performance by the insertion element 5 is not impaired.

Based on the foregoing descriptions, the second end of the insertion element 5 may also extend into the second sealant groove 4. In this case, there may also a spacing between the second end of the insertion element 5 and the bottom of the second sealant groove 4, so as to well serve the effect of the insertion element 5.

In some embodiments, as shown in FIG. 2, the storage and transportation device further comprises a locking mechanism 6, and the locking mechanism 6 is configured to lock the cover 1 to the supporting plate 2.

The locking mechanism 6 may be a fastener. After the cover 1 covers the supporting plate 2, the cover 1 and the supporting plate 2 may be locked by the fastener in a covering direction.

The locking mechanism 6 may also be a bolt and a nut. The open end 12 of the cover 1 and the supporting plate 2 may be provided with threaded holes in the covering direction. After the cover 1 covers the supporting plate 2, bolts can pass through the threaded holes in the open end 12 of the cover 1 and the supporting plate 2, and nuts are screwed on the bolt to lock the cover 1 to the supporting plate 2.

The cover 1 is locked to the supporting plate 2 by the locking mechanism 6 to enhance the stability of a connection between the cover 1 and the supporting plate 2, preventing the failure in the connection between the cover 1 and the supporting plate 2 during transportation which may otherwise result in a gap and thus inefficient sealing. In addition, the locking mechanism 6 locks the cover 1 to the supporting plate 2, so that the gap between the cover 1 and the supporting plate 2 can be reduced, and thus the amount of the sealant used to seal the gap can be reduced. Furthermore, the sealant in the first sealant groove 3 and the second sealant groove 4 and at the sealed junction are compressed during locking, and it is easy to achieve uniform distribution of the sealant over a larger area at the sealed junction under the action of compression, which is beneficial to improving the sealing effect of the sealant.

In some embodiments, as shown in FIGS. 10 and 11, a connector 7 is provided at the open end 12 of the cover 1 in the circumferential direction, and the connector 7 protrudes from an outer wall of the cover 1, is configured to connect the cover 1 to the supporting plate 2, and is in contact with the sealant.

The connector 7 may be a folded edge that is arranged at the open end 12 of the cover 1 and that protrudes from the outer wall of the cover 1, or may be a flange connected to the open end 12 of the cover 1, and an outer edge of the flange protrudes from the outer wall of the cover 1.

A side of the connector 7 facing the supporting plate 2 may be coated with the sealant, and the sealant applied on the connector 7 may be in contact with the sealant on the supporting plate 2.

The portion of the connector 7 protruding from the outer wall of the cover 1 can increase the contact surface between the cover 1 and the supporting plate 2, thereby facilitating locking of the cover 1 and the supporting plate 2, and preventing the failure in the connection between the cover 1 and the supporting plate 2 fails during transportation and thus the sealing effect cannot be achieved. The connector 7 is in contact with the sealant, thereby increasing the sealing area between the cover 1 and the supporting plate 2, effectively cutting off the passage for moisture, and reducing the possibility of moisture entry to ensure that the humidity in the storage and transportation device remains constant.

According to some embodiments of the present application, referring to FIGS. 1 to 11, the present application provides a storage and transportation device, comprising a cover 1, a supporting plate 2, and a sealant. The cover 1 has an opening 11, and the supporting plate 2 covers the opening 11 to form a space for accommodating an item to be transported. The storage and transportation device further comprises a first sealant groove 3 and a second sealant groove 4 that are in communication with each other. The first sealant groove 3 and the second sealant groove 4 are located at the sealed junction between the cover 1 and the supporting plate 2 and are arranged on the supporting plate 2 in a circumferential direction of the cover 1. The first sealant groove 3 and the second sealant groove 4 are first filled with the sealant, the two parts of sealant are connected, then the cover 1 covers the supporting plate 2, and the cover 1 and the supporting plate 2 are locked by the locking mechanism 6, so that the sealant is uniformly distributed in the gap, and the sealing performance of the storage and transportation device is improved.

Those skilled in the art should understand that, although some of the embodiments herein include some but not other features included in other embodiments, the combination of the features of different embodiments means being within the scope of the present application and forms different embodiments. For example, in the claims, any one of the claimed embodiments may be used in any combination.

In conclusion, the above embodiments are merely used for illustrating rather than limiting the technical solutions of the present application. Although the present application has been illustrated in detail with reference to the foregoing embodiments, it should be understood by those of ordinary skill in the art that modifications can still be made to the technical solutions described in the foregoing embodiments, or equivalent substitutions of some technical features thereof are also possible; and while these modifications or substitutions do not make the essence of the corresponding technical solutions depart from the spirit and scope of the technical solutions of the embodiments of the present application.

The invention claimed is:

1. A storage and transportation device comprising:

a cover having an opening;

a supporting plate covering the opening to form a space for accommodating an item to be transported; and a sealant for sealing the cover and the supporting plate, wherein the storage and transportation device further comprises a first sealant groove and a second sealant groove, the first sealant groove being arranged at a sealed junction between the cover and the supporting plate; the sealant comprises a first part and a second part, the first part and the second part being respectively located in the first sealant groove and the second sealant groove, and the first part being connected to the second part, wherein an insertion element is further arranged at the sealed junction, and the insertion element has a first end and a second end opposite to each other, the first end being connected to the cover or the supporting plate, and the second end extending into the first sealant groove, wherein there is a spacing between the second end of the insertion element and a bottom of the first sealant groove.

2. The storage and transportation device according to claim 1, wherein the first sealant groove is in communication with the second sealant groove.

3. The storage and transportation device according to claim 1, wherein both the first sealant groove and the second sealant groove are arranged on an open end of the cover in a circumferential direction of the cover.

4. The storage and transportation device according to claim 1, wherein both the first sealant groove and the second sealant groove are arranged on the supporting plate in the circumferential direction of the cover.

5. The storage and transportation device according to claim 1, wherein one of the first sealant groove and the second sealant groove is arranged on the open end of the cover in the circumferential direction of the cover, and the other one of the first sealant groove and the second sealant groove is arranged on the supporting plate in the circumferential direction of the cover.

6. The storage and transportation device according to claim 1, wherein a plurality of the second sealant grooves are provided, and the plurality of second sealant grooves are staggered with each other.

7. The storage and transportation device according to claim 6, wherein the second sealant grooves are arranged on each of the open end of the cover and the supporting plate.

8. The storage and transportation device according to claim 1, wherein the insertion element is an annular structure extending in the circumferential direction of the cover, and is connected to the cover or the supporting plate.

9. The storage and transportation device according to claim 1, wherein the storage and transportation device further comprises a locking mechanism configured to lock the cover to the supporting plate.

10. The storage and transportation device according to claim 1, wherein a connector is provided on the open end of the cover in the circumferential direction, and the connector protrudes from an outer wall of the cover, is configured to connect the cover to the supporting plate, and is in contact with the sealant.

* * * * *